US008640720B1

(12) United States Patent
Roberto

(10) Patent No.: US 8,640,720 B1
(45) Date of Patent: Feb. 4, 2014

(54) LARGE PARASOL WITH A TEXTILE FABRIC ROOF

(71) Applicant: Claudio Roberto, Kirchberg (CH)

(72) Inventor: Claudio Roberto, Kirchberg (CH)

(73) Assignee: Glatz AG (CH)

( * ) Notice: Subject to any disclaimer, the term of this patent is extended or adjusted under 35 U.S.C. 154(b) by 0 days.

(21) Appl. No.: 13/737,194

(22) Filed: Jan. 9, 2013

(51) Int. Cl.
*A45B 25/18* (2006.01)
*A45B 9/04* (2006.01)

(52) U.S. Cl.
USPC ..... 135/33.5; 135/26; 135/33.2; 52/222

(58) Field of Classification Search
USPC ..... 135/29, 33.2, 33.4–33.6, 44, 115, 119; 52/63, 74, 222; 24/18, 459; 403/291, 403/294
See application file for complete search history.

(56) References Cited

U.S. PATENT DOCUMENTS

| | | | | | |
|---|---|---|---|---|---|
| 2,017,753 | A * | 10/1935 | Goldman | 135/33.5 |
| 2,914,008 | A * | 11/1959 | Malin | 112/114 |
| 3,431,926 | A * | 3/1969 | Emanuel | 135/33.41 |
| 3,873,821 | A * | 3/1975 | Larson | 362/3 |
| 4,624,275 | A * | 11/1986 | Baldwin | 135/19.5 |
| 5,235,997 | A * | 8/1993 | Good | 135/25.3 |
| 5,487,401 | A * | 1/1996 | Johnson et al. | 135/33.7 |
| 5,640,984 | A * | 6/1997 | Dubunsky | 135/33.2 |
| 6,651,682 | B1 * | 11/2003 | Woodward | 135/28 |
| 2005/0247333 | A1 * | 11/2005 | Nipke | 135/24 |
| 2005/0253411 | A1 * | 11/2005 | Chai et al. | 296/97.1 |
| 2007/0125409 | A1 * | 6/2007 | Cullen | 135/33.41 |

FOREIGN PATENT DOCUMENTS

| | | | | |
|---|---|---|---|---|
| CH | 648 083 | A5 | 2/1985 | |
| CN | 2 894 894 368 | Y | 5/2007 | |
| CN | 201 393 636 | Y | 2/2010 | |
| DE | 84 30 086 | U1 | 1/1985 | |
| DE | 37 21 830 | A1 | 1/1989 | |
| DE | 20 2011 004 028 | U1 | 5/2011 | |
| EP | 0 587 529 | A2 | 3/1994 | |
| EP | 916281 | A2 * | 5/1999 | A45B 25/18 |
| WO | WO 92/13 470 | A1 | 8/1992 | |

* cited by examiner

*Primary Examiner* — Winnie Yip
(74) *Attorney, Agent, or Firm* — George Pappas

(57) ABSTRACT

In a large parasol with a textile fabric roof with adjustable canopy strut ends for the attachment of the canopy fabric, in order to avoid the attaching seams of the canopy fabric from being openly exposed to the UV radiation and to prevent the connection to the fabric roof from becoming displaced or twisted inadvertently either in the open state or in the closed and relaxed state of the parasol, welt bulges are attached to the parasol roof edge along the seams of the parasol roof parts, the extensions comprising welt grooves, the welt bulges engaging in the welt grooves of the extensions and the welt bulges being held at the outer end of the extensions by means of a screw.

14 Claims, 2 Drawing Sheets

LARGE PARASOL WITH A TEXTILE FABRIC ROOF

This application claims priority from German application No. DE 202012000527.8 having a priority date of Jan. 20, 2012, the disclosure of which is incorporated herein by reference.

TECHNICAL FIELD

The invention relates to a large parasol with a textile fabric roof with adjustable canopy strut ends for the attachment of the canopy fabric.

BACKGROUND OF THE INVENTION

In the case of large parasols various fabric qualities can be used for manufacturing the parasol roof. This means that upon opening and closing the parasol the canopy fabrics stretch and warp in a different manner. Moreover, the dimensional stability and the stretching behavior of the fabric change over the lifetime. For a perfect fit of the canopy fabric it is advantageous if the position of the canopy strut ends can be adjusted individually.

Moreover, there are large parasols wherein the parasol roof is sewn together in such a manner that the seams are exposed to radiation, particularly to UV radiation, and therefore become permanently damaged. It is desirable if this can be avoided for the strained regions of the canopy strut ends.

In principle, welts are already known in the relevant technical field, e.g. from DE 84 30 086 U1 or CH 648 083 A5 for marquees, wherein a tension transverse to the welt shall be countered, or also for parasol roofs from WO 92/13470 A1, from CN 2894368 Y or CN 201393636 Y, wherein two fabric parts are joined together by means of the welts and wherein again a tension transverse to the welt is applied.

SUMMARY OF THE INVENTION

The object of the invention is a large parasol with a canopy strut end that is suitable for further tensioning, wherein the attaching seams of the canopy fabric are not openly exposed to the UV radiation. The connection to the fabric roof shall not be allowed to become displaced or twisted inadvertently either in the open state or in the closed and relaxed state of the parasol.

The measures of the invention have the result for the large parasol according to the present invention that, on the one hand, the selected position of the connection between the parasol fabric and the canopy struts cannot be inadvertently twisted or displaced in any direction and, on the other hand, the attachment seams are at the bottom side of the parasol fabric which is protected from UV radiation. Moreover, manufacturing is simplified in comparison with the embodiments according to the prior art.

It is advantageous if the welt bulges are unilaterally attached onto the seams. Alternatively, the welt bulges can surround the seams in a clamp-like manner, which results in a particularly robust embodiment.

In order to adapt the fabric roof to the large parasol, it is advantageous if the profile of the canopy struts and the extensions thereof comprise perforations and if pintles are provided which hold the extensions in their position by insertion through the perforations.

It is particularly advantageous if end caps or end plugs cover the injury-prone profile edges.

The aforementioned elements as well as those claimed and described in the following exemplary embodiments, to be used according to the invention, are not subject to any particular conditions by way of exclusion in terms of their size, shape, use of material and technical design, with the result that the selection criteria known in the respective field of application can be used without restrictions.

BRIEF DESCRIPTION OF THE DRAWINGS

Further details, advantages and features of the object of the present invention will become apparent from the following description and the corresponding drawings, in which parasols according to the present invention are illustrated by way of example. In the drawings there is shown, in.

DETAILED DESCRIPTION OF THE PREFERRED EMBODIMENTS

Figure 1:
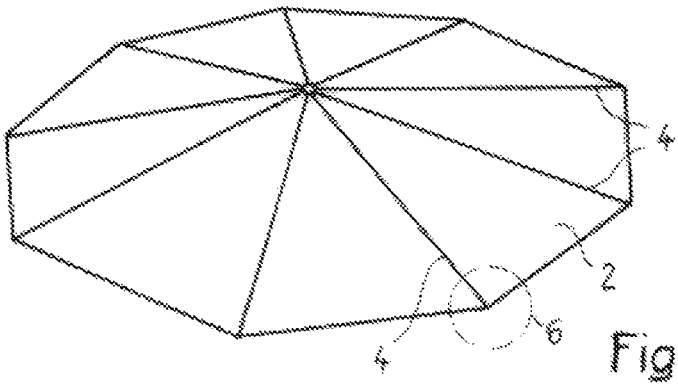
FIG. 1 a perspective view of the roof of a large parasol, according to a preferred exemplary embodiment of the invention.

The large parasol shown in FIG. 1 comprises a parasol roof 2, which in the present exemplary embodiment is made of a textile material and is sewn together in each case approximately above the canopy struts 4.

Figure 2:
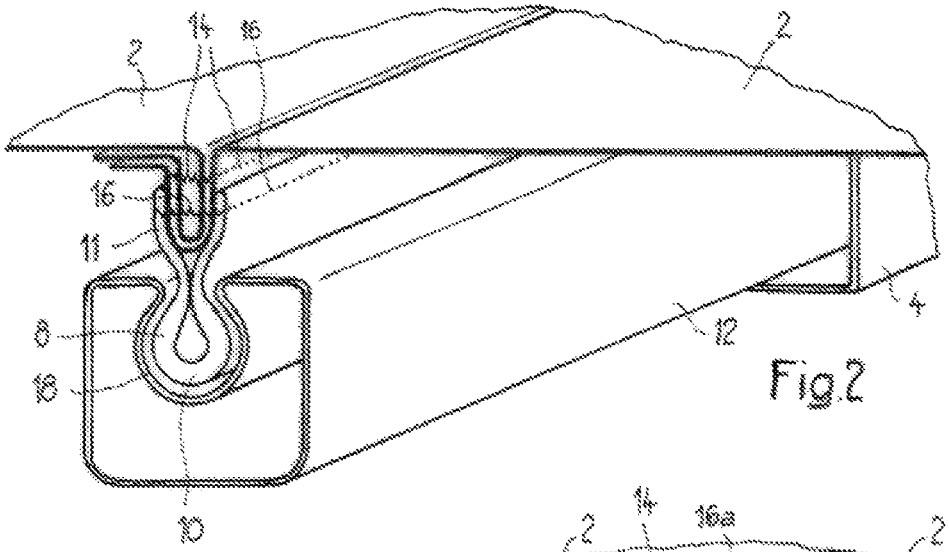
FIG. 2 a perspective view of a strut end of the large parasol acceding to FIG. 1.
Figure 3:
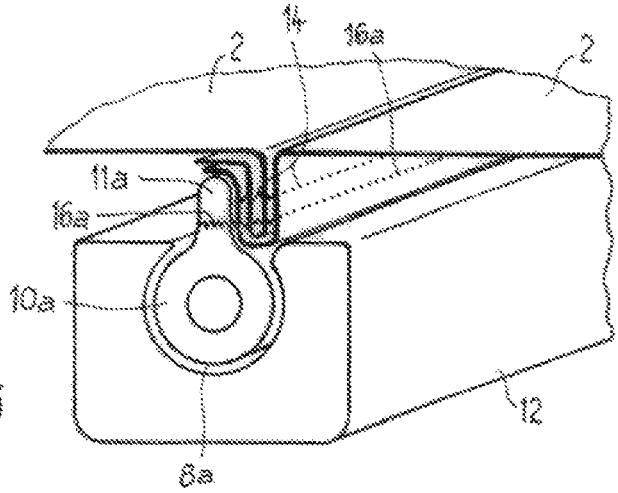
FIG. 3 a perspective view of an alternative strut end of the large parasol.

In FIG. 2 there is shown a strut end 6 of a canopy strut 4 wherein the welt bulge 10 of a welt part 8 is inserted into the extension 12 of the canopy strut 4. The welt part 8 comprises, in addition to the welt bulge 10 that has substantially the shape of a circle segment with a segment of about 340°, welt connection strips 11 at both sides thereof, so that the two welt connection strips 11 can receive the roof fabric. In this exemplary embodiment there are two seams, namely, firstly the seam 14 by means of which the two textile fabric parts of the parasol roof are sewn together throughout, and secondly, a welt seam 16 by means of which the welt 8 is sewn to the fabric received between the welt connection strips 11.

The welt is inserted together with the welt bulge 10 into a welt groove 18 of the extension 12, and a welt screw 20 is inserted into the end of the welt 8 directed towards the extension 12—i.e. approximately into the middle of the welt bulge 10 shaped as a circle segment according to the present exemplary embodiment—in such manner that the welt 8 and the fabric roof connected thereto are tensioned outwardly by means of the welt screw itself or by means of a washer. It should be mentioned that—although welts are already known for marquees etc.—such type of using a welt wherein the tension is exerted along the welt and not transversely to the welt as in the case of marquees is quite unusual and requires support by means of a stable seam 16.

In the present exemplary embodiment the extension and concomitantly the welt 8 and the welt screw 20 are covered with end caps 24 so as to protect the injury-prone profile edges of the extension 12 and to provide an esthetically pleasing appearance.

Figure 5:
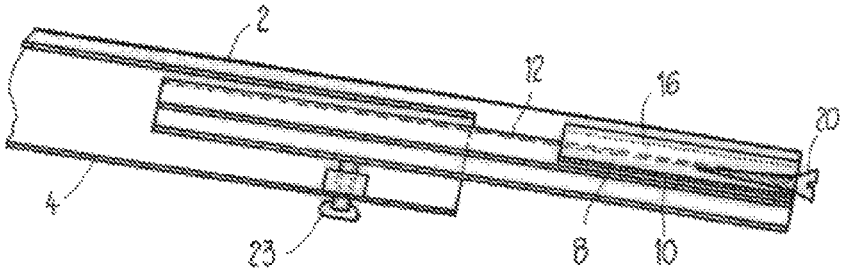
FIG. 5 a schematic view of an alternative strut of the large parasol.

In the present exemplary embodiment the extension 12 and the canopy struts 4 are provided with perforations 21. Moreover, pintles 22 are provided which by insertion through the perforations 21 hold the extension 12 positioned in its longitudinal direction with respect to the canopy strut 4. With this means the extension 12 and concomitantly the fabric roof 2 can be pretensioned with respect to the canopy strut 4. Alternatively and as shown in FIG. 5, a clamping screw 23 that is arranged in the canopy strut 4 can be screwed against the extension 12 in such manner that the extension 12 is held positioned in its longitudinal direction with respect to the canopy strut 4.

Figure 4:
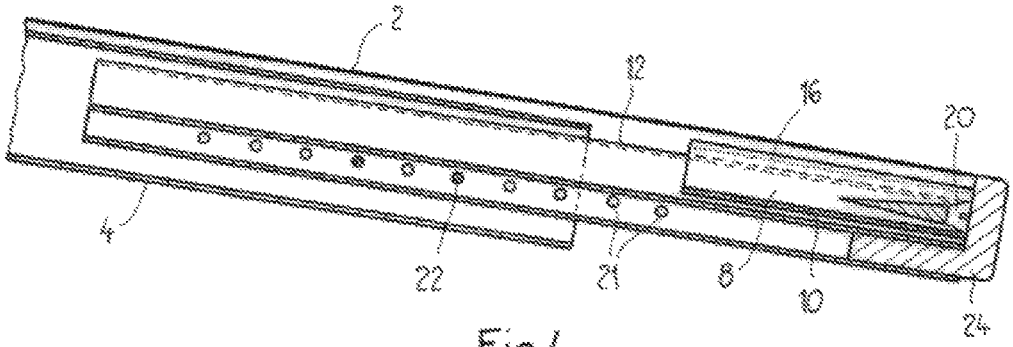
FIG. 4 a schematic view of a strut of the large parasol acceding to FIG. 1.

In an alternative embodiment according to FIG. 4 the welt 8*a* and concomitantly the welt bulge 10*a* are shaped as a full circle and attached to the welt bulge 10 merely by means of one welt strip 11*a*. In this case the fabric fold sewn together is not inserted between the two welt strips and sewn to the two welt strips as in the exemplary embodiment described above, but rather is attached onto the welt strip 11*a* and sewn thereto by means of the welt seam 18*a*.

LIST OF REFERENCE NUMERALS

2 parasol roof
4 canopy struts
8 welt
8*a* welt
10 welt bulge
10*a* welt bulge
11 welt connection strips
11*a* welt connection strips
12 extension
14 seam
16 welt seam
16*a* welt seam
18 welt groove of the extension
20 welt screw
21 perforations
22 pintle
23 clamping screw
24 end cap

The invention claimed is:

1. Large parasol with a textile fabric roof and canopy struts, wherein the fabric roof is attached to the ends of the canopy struts, the ends of the canopy struts comprising telescopically adjustable extensions and the textile fabric roof being sewn together from fabric roof parts, the seams of the parasol roof parts extending along the canopy struts, characterized in that:

welt bulges are attached to the parasol roof edge along the seams of the parasol roof parts, the extensions comprising welt grooves, the welt bulges engaging in the welt grooves of the extensions and the welt bulges being held at the outer end of the extensions by means of a screw.

2. Large parasol with a textile fabric roof and canopy struts according to claim 1, characterized in that the welts comprise welt connection strips onto which the mutually sewn parasol roof parts are unilaterally sewn by means of a welt seam.

3. Large parasol with a textile fabric roof and canopy struts according to claim 2, characterized in that the extensions are held in position with clamping screws of the roof profile.

4. Large parasol with a textile fabric roof and canopy struts according to claim 2, characterized in that the canopy strut profile and the extensions comprise perforations and that pintles are provided which hold the extensions in their position by insertion through the perforations.

5. Large parasol with a textile fabric roof and canopy struts according to claim 2, characterized in that the outer ends of the extensions are each closed by means of an end cap or an end plug.

6. Large parasol with a textile fabric roof and canopy struts according to claim 1, characterized in that the welts each comprise two welt connection strips between which are arranged the mutually sewn parasol roof parts and which welt connection strips are sewn together by means of a welt seam.

7. Large parasol with a textile fabric roof and canopy struts according to claim 6, characterized in that the extensions are held in position with clamping screws of the roof profile.

8. Large parasol with a textile fabric roof and canopy struts according to claim 6, characterized in that the canopy strut profile and the extensions comprise perforations and that pintles are provided which hold the extensions in their position by insertion through the perforations.

9. Large parasol with a textile fabric roof and canopy struts according to claim 6, characterized in that the outer ends of the extensions are each closed by means of an end cap or an end plug.

10. Large parasol with a textile fabric roof and canopy struts according to claim 1, characterized in that the extensions are held in position with clamping screws of the roof profile.

11. Large parasol with a textile fabric roof and canopy struts according to claim 10, characterized in that the outer ends of the extensions are each closed by means of an end cap or an end plug.

12. Large parasol with a textile fabric roof and canopy struts according to claim 1, characterized in that the canopy strut profile and the extensions comprise perforations and that pintles are provided which hold the extensions in their position by insertion through the perforations.

13. Large parasol with a textile fabric roof and canopy struts according to claim 12, characterized in that the outer ends of the extensions are each closed by means of an end cap or an end plug.

14. Large parasol with a textile fabric roof and canopy struts according to claim 1, characterized in that the outer ends of the extensions are each closed by means of an end cap or an end plug.

* * * * *